US007171875B2

(12) United States Patent
Hu

(10) Patent No.: US 7,171,875 B2
(45) Date of Patent: Feb. 6, 2007

(54) ADJUSTABLE HEAD FOR A WRENCH

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 90 days.

(21) Appl. No.: 10/747,387

(22) Filed: Dec. 29, 2003

(65) Prior Publication Data

US 2004/0144218 A1 Jul. 29, 2004

(30) Foreign Application Priority Data

Jan. 28, 2003 (TW) ..... 92102133 A

(51) Int. Cl.
*B25B 23/16* (2006.01)

(52) U.S. Cl. ..... 81/177.8; 81/177.6; 81/177.7; 81/177.9

(58) Field of Classification Search ..... 81/177.9, 81/177.8, 177.7, 177.1, 177.75
See application file for complete search history.

(56) References Cited

U.S. PATENT DOCUMENTS

| | | | | | |
|---|---|---|---|---|---|
| 2,518,139 | A | | 8/1950 | Hallowell et al. | 279/75 |
| 4,084,456 | A | | 4/1978 | Pasbrig | 81/125.1 |
| 4,463,632 | A | | 8/1984 | Parke | 81/177.9 |
| 4,711,145 | A | * | 12/1987 | Inoue | 81/177.1 |
| 4,794,829 | A | | 1/1989 | Mesenhoeller | 81/177.8 |
| 4,901,608 | A | * | 2/1990 | Shieh | 81/177.8 |
| 5,199,335 | A | | 4/1993 | Arnold et al. | 81/177.8 |
| 5,289,745 | A | | 3/1994 | Beardsley | 81/177.2 |
| 5,916,339 | A | | 6/1999 | Dumont | 81/63.1 |
| 5,964,129 | A | | 10/1999 | Shiao | 81/63.2 |
| 6,000,302 | A | * | 12/1999 | Chiang | 81/177.8 |
| 6,131,490 | A | * | 10/2000 | Lee | 81/63.1 |
| 6,148,695 | A | * | 11/2000 | Hu | 81/60 |
| 6,148,698 | A | * | 11/2000 | Hsieh | 81/177.8 |
| 6,216,567 | B1 | * | 4/2001 | Hu | 81/177.9 |
| 6,220,125 | B1 | * | 4/2001 | Lan | 81/177.9 |
| D441,625 | S | | 5/2001 | Chen | D8/28 |
| 6,295,898 | B1 | * | 10/2001 | Hsieh | 81/177.8 |
| D485,143 | S | | 1/2004 | Yang | D8/28 |

(Continued)

FOREIGN PATENT DOCUMENTS

DE 3006651 8/1981

(Continued)

OTHER PUBLICATIONS

Snap-on Catalog, p. 168 and 119, 1994.

*Primary Examiner*—Lee D. Wilson
*Assistant Examiner*—Robert Scruggs
(74) *Attorney, Agent, or Firm*—Alan D. Kamrath; Nikolai & Mersereau, P.A.

(57) ABSTRACT

A wrench includes a handle, a head having a pivotal portion pivotably connected to an end of the handle, and a retaining mechanism. The pivotal portion of the head includes two end portions and an intermediate portion between the end portions. The intermediate portion includes an arcuate outer surface section that has teeth to be releasably engaged with the retaining mechanism, allowing the head to be pivotally moved to a desired position relative to the handle and retaining the head in the desired position. Thus, the thickness of the respective end portion of the pivotal portion of the head is not reduced, preventing damage to the torque-bearing section in the respective end portion of the pivotal portion during operation.

20 Claims, 16 Drawing Sheets

U.S. PATENT DOCUMENTS

| | | | | |
|---|---|---|---|---|
| D488,967 | S | 4/2004 | Hsien | D8/25 |
| 6,745,650 | B1 | 6/2004 | Chang | 81/177.8 |
| 6,848,345 | B2 * | 2/2005 | Lin | 81/177.8 |
| D507,464 | S | 7/2005 | Hu | D8/25 |
| 6,957,600 | B2 * | 10/2005 | Hu | 81/177.8 |
| 2004/0144217 | A1 | 7/2004 | Hu | 81/177.8 |

FOREIGN PATENT DOCUMENTS

| | | |
|---|---|---|
| DE | 3732695 | 3/1989 |
| DE | 9819457 | 9/1999 |

* cited by examiner

ADJUSTABLE HEAD FOR A WRENCH

BACKGROUND OF THE INVENTION

1. Field of the Invention

The present invention relates to an adjustable head for a wrench. In particular, the present invention relates to a wrench including a handle and a head that can be pivotally adjusted to and retained in a desired angular position relative to the handle.

2. Description of the Related Art

FIG. 1 of the drawings illustrates a conventional wrench including a handle 4 and a head 1 that can be pivotally adjusted to a desired angular position relative to the handle 4. FIG. 2 is a top view of the head 1. A plurality of angularly spaced grooves 3 are defined in an arcuate outer surface section of a pivotal portion 2 of the head 1, and the handle 4 includes a ball 5 selectively engaged in one of the grooves 3 of the head 1. The ball 5 is apt to disengage from the respective groove 3 of the head 1 if the grooves 3 are too shallow. On the other hand, if the grooves 3 are deep for providing reliable engagement between the ball 5 and the respective groove 3, at best five (5) grooves 3 are allowed to be defined in the arcuate outer surface section of the pivotal portion 2 of the head 1. Thus, the head 1 can be located in at best five angular positions relative to the handle 4. Further, two adjacent angular positions are spaced apart from each other by thirty-six (36) degrees. As a result, use of the handle 4 in a limited space is difficult. Namely, adjustment of the angular position of the head 1 relative to the handle 4 in a limited space is difficult.

FIG. 3 of the drawings illustrate another conventional wrench including a handle 20 and a head 10 that can be pivotally adjusted to a desired angular position relative to the handle 20. FIG. 4 is a top view of the head 10, and FIG. 5 is a side view of the head 10.

The handle 20 includes a pair of lugs 21 on an end thereof, and a pin 18 is extended through aligned holes 22 in the lugs 21 and a pin hole 14 in a pivotal portion 13 of the head 10, thereby pivotally connecting the pivotal portion 13 of the head 10 to the lugs 21 of the handle 20. Teeth 15 are formed along an arcuate outer surface section of the pivotal portion 13 of the head 10 for releasably engaging with a pawl or catch 17 mounted in the end of the handle 20. Thus, the head 10 moves together with the handle 20 for driving fasteners when the catch 17 is engaged with the teeth 15 of the head 10. The head 10 can be pivoted to a desired position relative to the handle 20 when the catch 17 is disengaged from the teeth 15 of the head 10.

In this wrench, formation of the teeth 15 along an entire arcuate outer surface section of the pivotal portion 13 of the head 10 causes a reduction in the thickness of the pivotal portion 13; namely, the distance from a periphery delimiting the pin hole 14 of the head 10 to the dedendum circle of the pivotal portion 13 of the head 10 is "L". As illustrated in FIG. 3, the pivotal portion 13 of the head 10 is subjected to a torque at sections 14*a* and 14*b* when the wrench is turned clockwise for driving a fastener. Cracks 16 are apt to be generated in the torque-bearing section 14*b*when the handle 20 is turned clockwise. The torque-bearing section 14*b*is damaged when the torque applied to the wrench is relatively large. Similarly, the pivotal portion 13 of the head 10 is subjected to a torque at sections 14*c* and 14*d* when the wrench is turned counterclockwise for driving a fastener. Cracks 16 are apt to be generated in the torque-bearing section 14*d* when the handle 20 is turned counterclockwise, as illustrated in FIG. 6. The device for retaining the head in a desired angular position relative to the handle sacrifices the torque-bearing capacity of the wrench.

SUMMARY OF THE INVENTION

In accordance with an aspect of the invention, a wrench includes a handle, a head having a pivotal portion pivotably connected to an end of the handle, and a retaining mechanism. The pivotal portion of the head includes two end portions and an intermediate portion between the end portions. The intermediate portion includes an arcuate outer surface section that has teeth to be releasably engaged with the retaining mechanism, allowing the head to be pivotally moved to a desired position relative to the handle and retaining the head in the desired position. Thus, the thickness of the respective end portion of the pivotal portion of the head is not reduced, preventing damage to the torque-bearing section in the respective end portion of the pivotal portion during operation.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
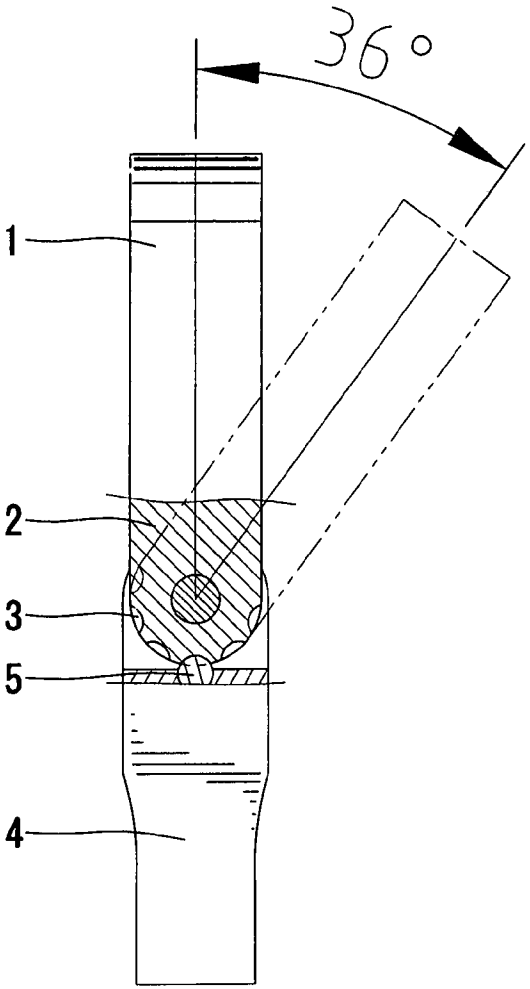
Fig. 1 PRIOR ART
FIG. 1 is a side view, party sectioned, of a conventional wrench.
Figure 2:
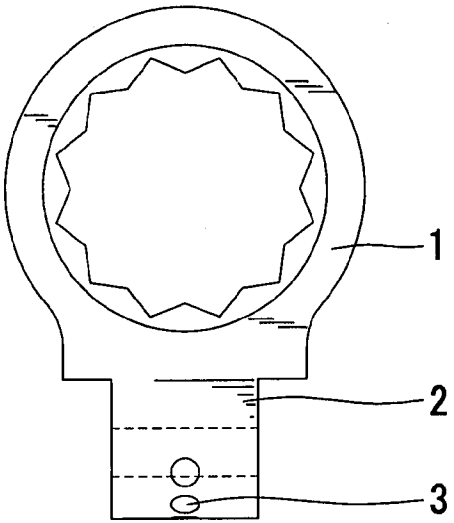
Fig. 2 PRIOR ART
FIG. 2 is a top view of a head of the conventional wrench in FIG. 1.
Figure 3:
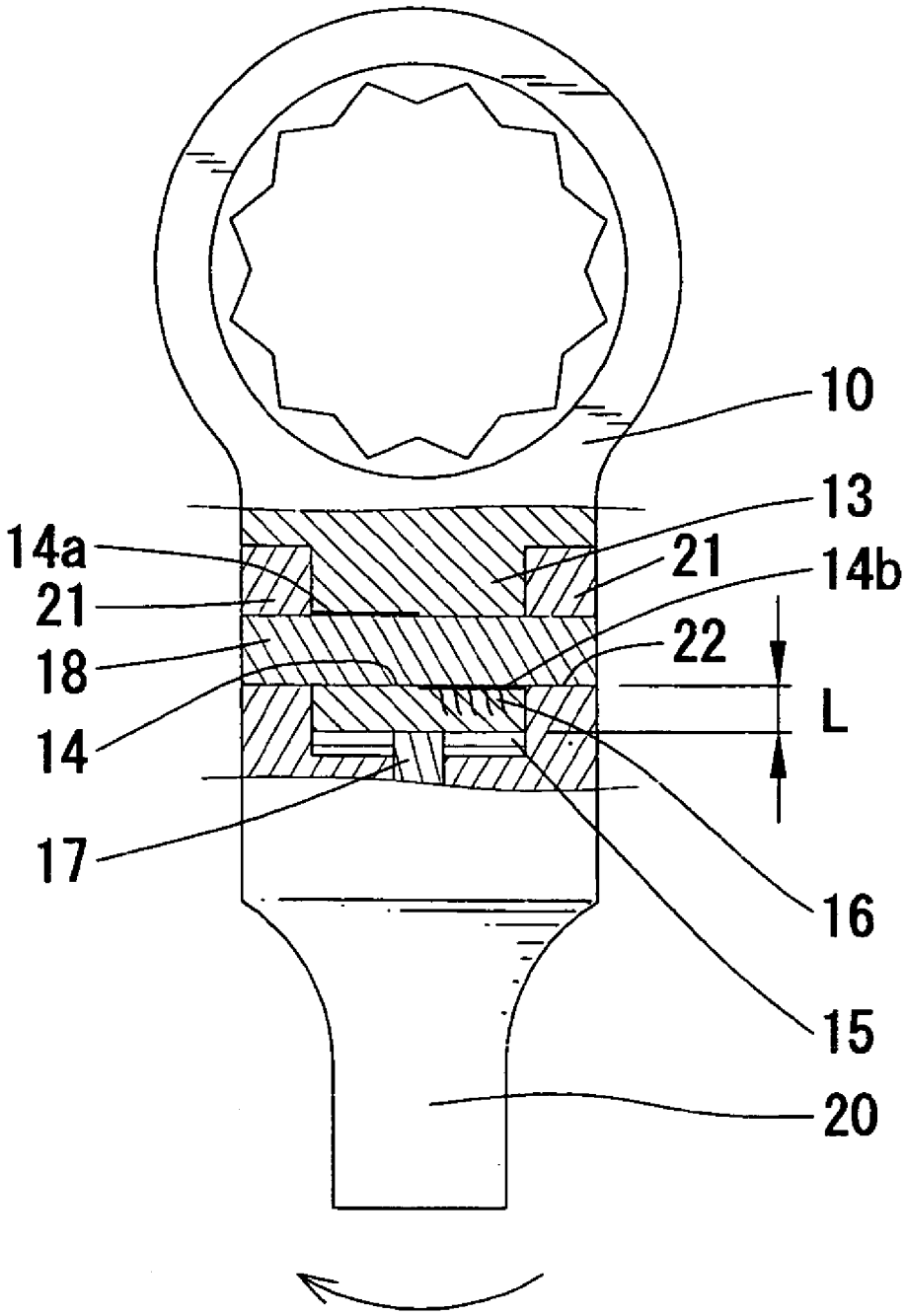
Fig. 3 PRIOR ART
FIG. 3 is a top view, partly sectioned, of another conventional wrench.
Figure 5:
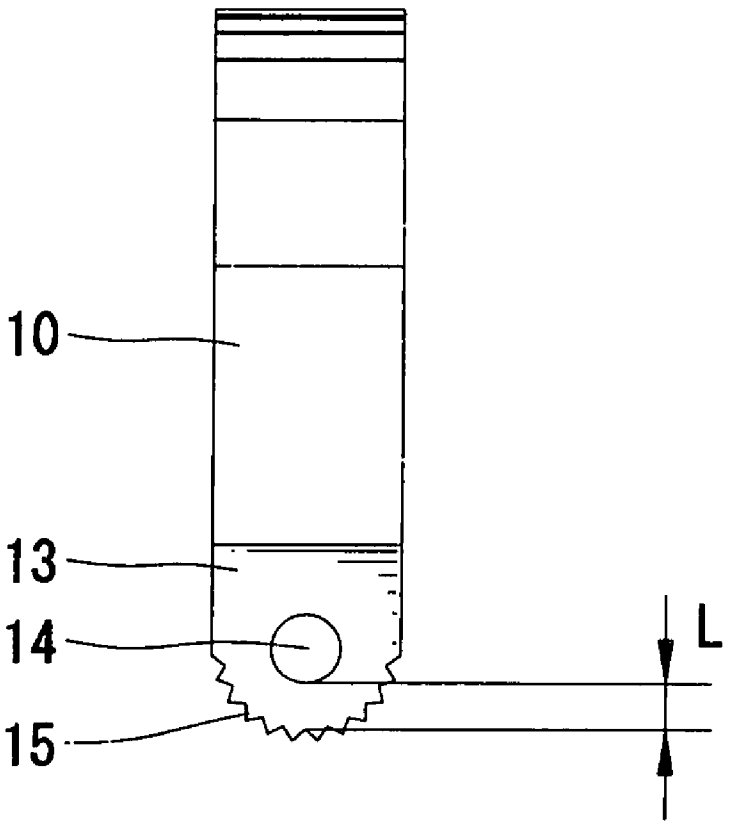
Fig. 5 PRIOR ART
FIG. 5 is a side view of the head in FIG. 4.
Figure 4:
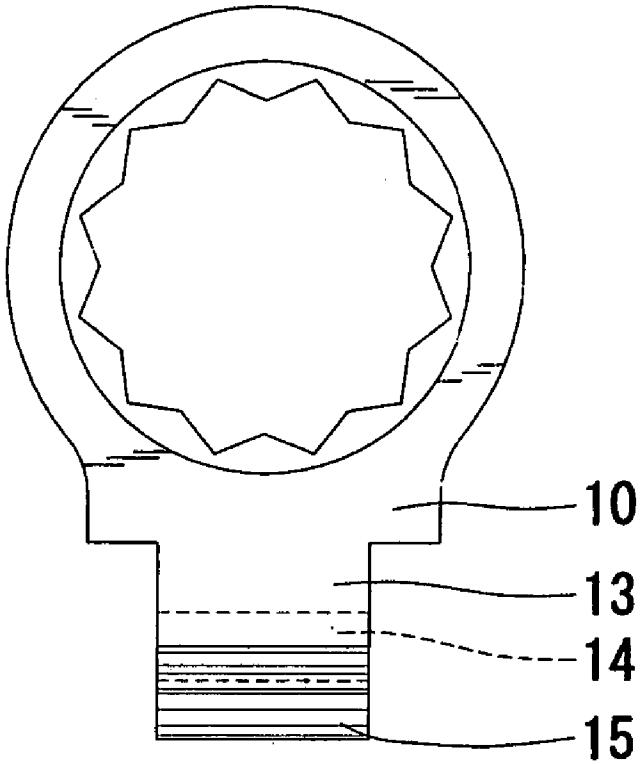
Fig. 4 PRIOR ART
FIG. 4 is a top view of a head of the conventional wrench in FIG. 3.
Figure 6:
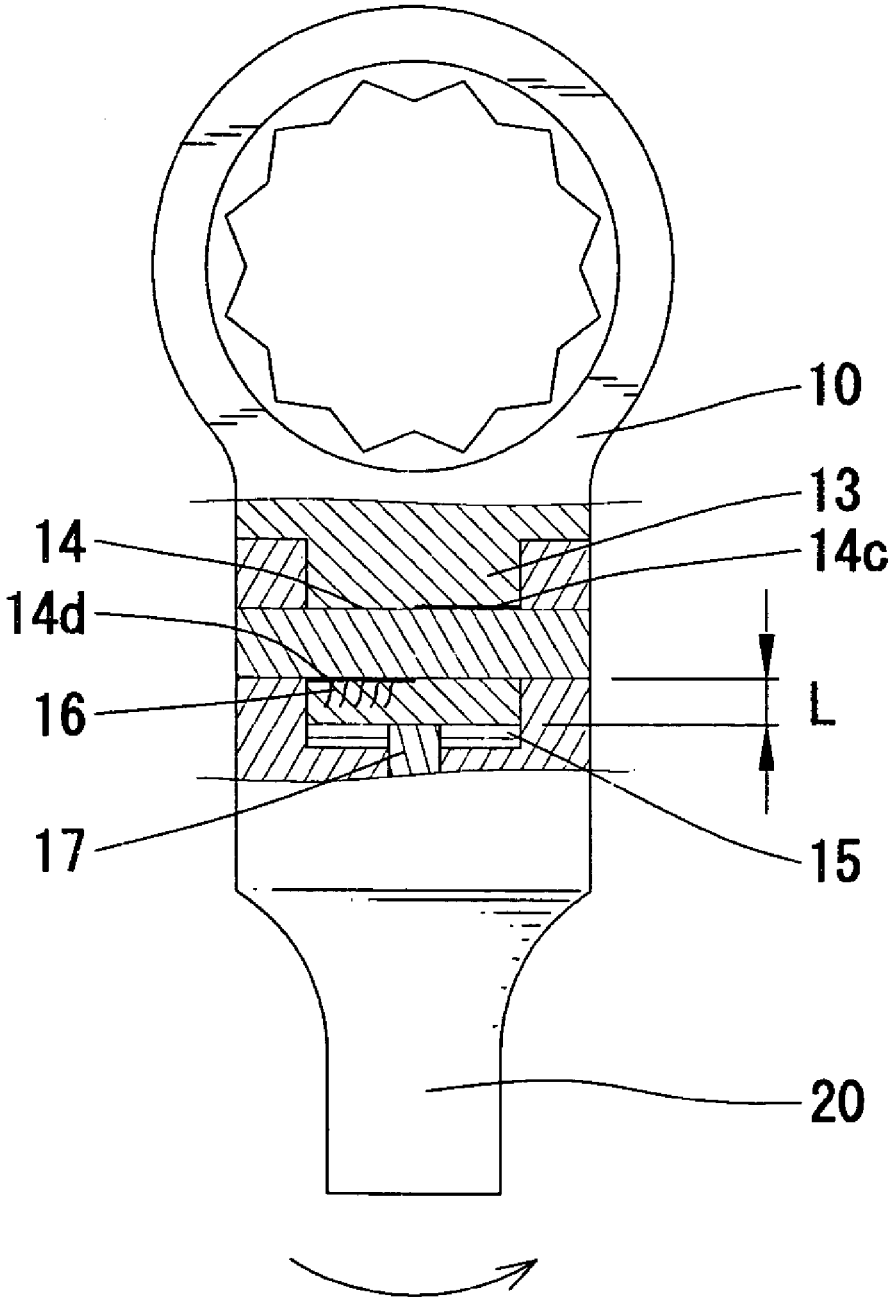
Fig. 6 PRIOR ART
FIG. 6 is a view similar to FIG. 3, illustrating operation of the wrench in a reverse direction.
Figure 7:
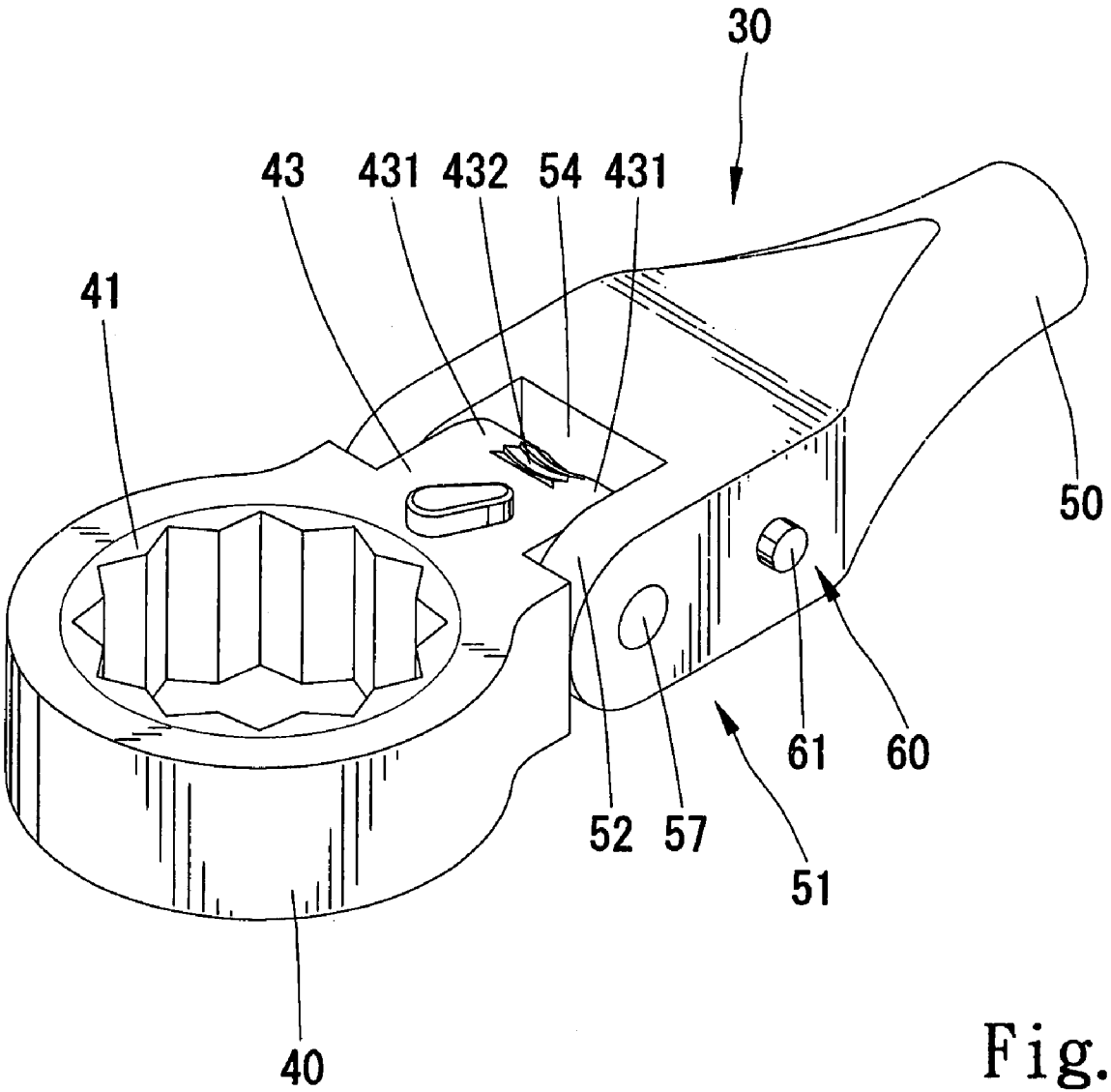
FIG. 7 is a perspective view of a wrench in accordance with the present invention.
Figure 8:
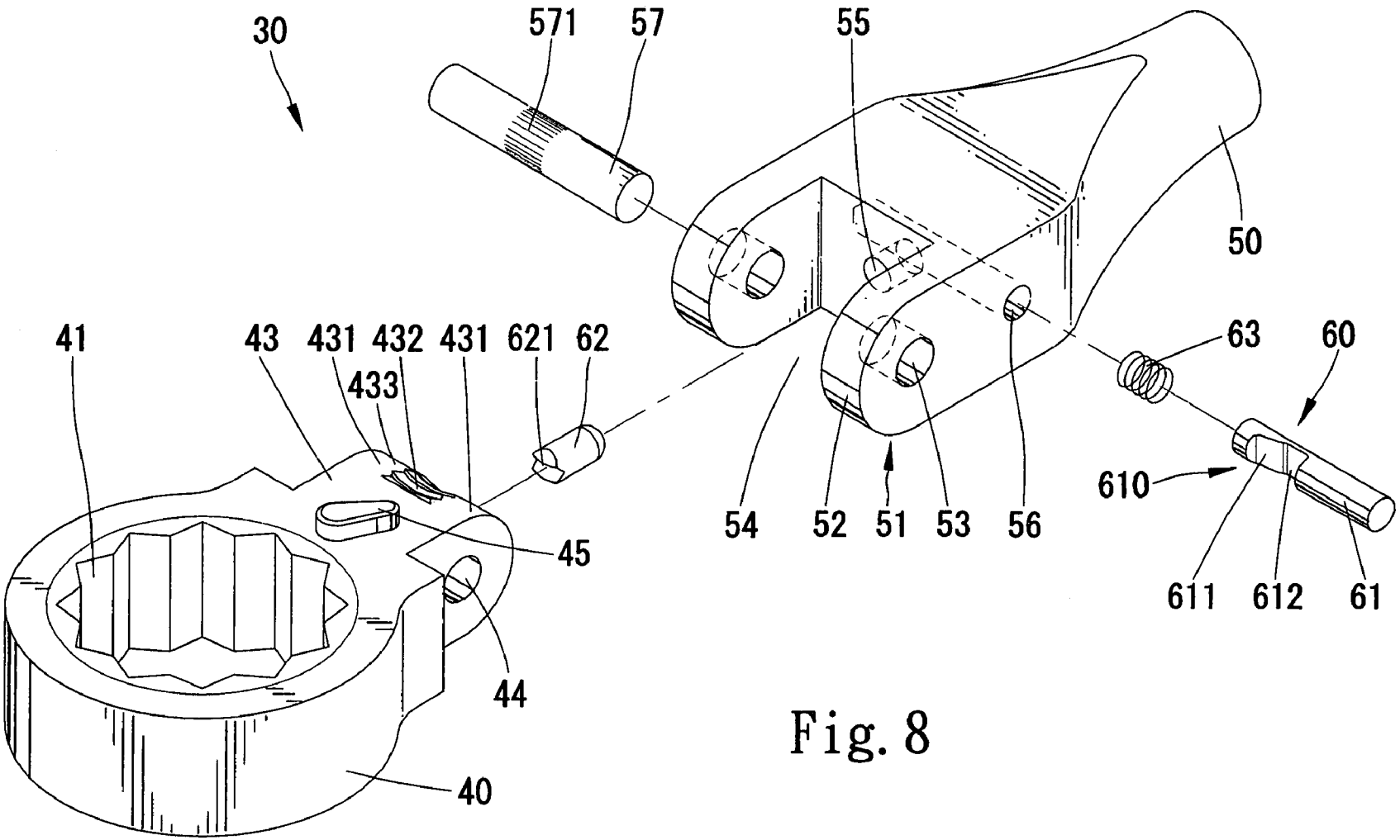
FIG. 8 is an exploded perspective view of the wrench in accordance with the present invention.

Referring to FIGS. 7 and 8, a wrench 30 in accordance with the present invention generally comprises a handle 50 and a head 40 that can be pivotally adjusted to a desired angular position relative to the handle 50. The handle 50 includes an engaging portion 51 on an end thereof. In this embodiment, the engaging portion 51 includes a pair of lugs 52 having aligned holes 53, with an opening 54 being defined between the lugs 52.

The head 40 includes a drive member 41 mounted therein for driving fasteners, and a switch 45 is provided for changing the ratcheting direction of the drive member 41, which is conventional and therefore not described in detail. The head 40 further has a pivotal portion 43 extending from the head 40. The pivotal portion 43 is received in the opening 54 of the handle 50 and includes a pin hole 44. A pin 57 is extended through the holes 53 in the lugs 52 and the pin hole 44 of the pivotal portion 43 of the head 40, thereby pivotally connecting the pivotal portion 43 of the head 40 to the lugs 52 of the handle 50. Preferably, the pin 57 has an embossed section 571 allowing the pin 57 to be tightly mounted in the pin hole 44.

The end of the handle 50 further has a receptacle 56 extending in a direction perpendicular to a longitudinal direction of the handle 50. The receptacle 56 opens in one of two lateral sides of the handle 50. An axial hole 55 is defined in the end of the handle 50 and communicated with the receptacle 56. A retaining mechanism 60 is provided for retaining the head 40 in a desired position relative to the handle 50 and includes an elastic element 63, a push member 61, and a catch 62. The elastic element 63 and the push member 61 are mounted in the receptacle 56, and the catch 62 is slidably mounted in the axial hole 55 and has a toothed portion 621 in an end thereof. The push member 61 includes a recessed portion 610 having a first face 611 and a second face 612, both facing the head 40. The first face 611 and the second face 612 are located at different heights, and the other end of the catch 62 selectively abuts against one of the first face 611 and the second face 612. An end of the push member 61 is biased by the elastic element 63 to a position located beyond the receptacle 56 for manual operation.

Figure 10:
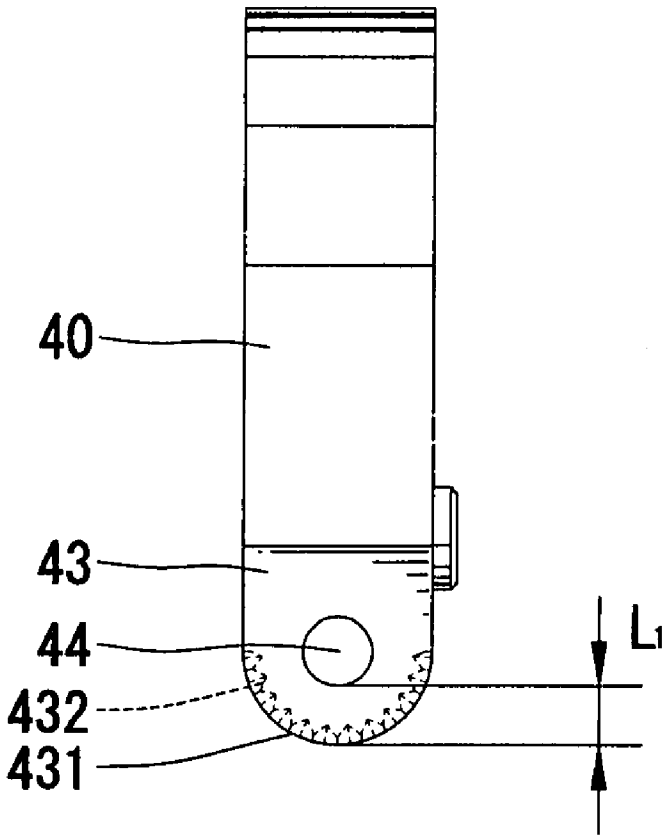
FIG. 10 is a side view of the head in FIG. 9.
Figure 9:
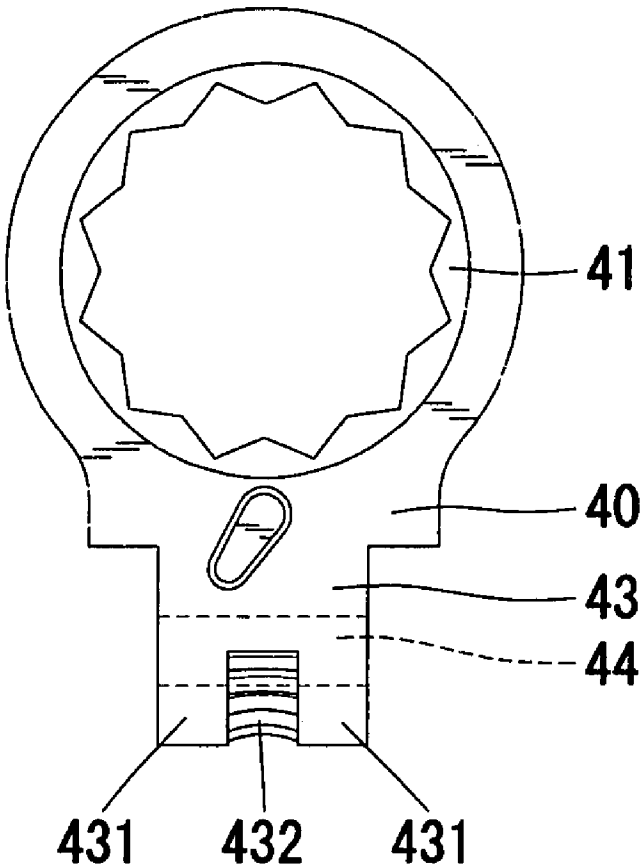
FIG. 9 is a top view of a head of the wrench in FIG. 7.

Referring to FIGS. 9 and 10, the pivotal portion 43 of the head 40 includes two end portions 431 and an intermediate portion 432 between the end portions 431. The intermediate portion 432 of the pivotal portion 43 includes a toothed section (not labeled) having a plurality of teeth (not labeled) on an arcuate outer surface section (not labeled) of the intermediate portion 432, and the respective end portion 431 of the pivotal portion 43 has a smooth arcuate outer surface section 433 without causing a reduction in the thickness. As illustrated in FIG. 10, a distance from a periphery delimiting the pin hole 44 to the arcuate outer surface section 433 of the respective end portion 431 of the pivotal portion 43 is "L1", which is greater than "L"in the conventional wrench (see FIGS. 3 through 6) of the same size. Further, the tip diameter circle of the teeth of the intermediate portion 432 of the pivotal portion 43 is located not higher than the arcuate outer surface section 433 of the respective end portion 431 of the pivotal portion 43, as shown in FIGS. 9 and 10. Namely, a distance from the tip diameter circle of the teeth of the intermediate portion 432 of the pivotal portion 43 to a periphery delimiting the pin hole 44 of the head 40 is not greater than that from the arcuate outer surface section 433 of the respective end portion 431 of the pivotal portion 43 to the periphery delimiting the pin hole 44 of the head 40. The respective teeth of the intermediate portion 432 of the pivotal portion 43 are preferably arcuate.

Figure 11:
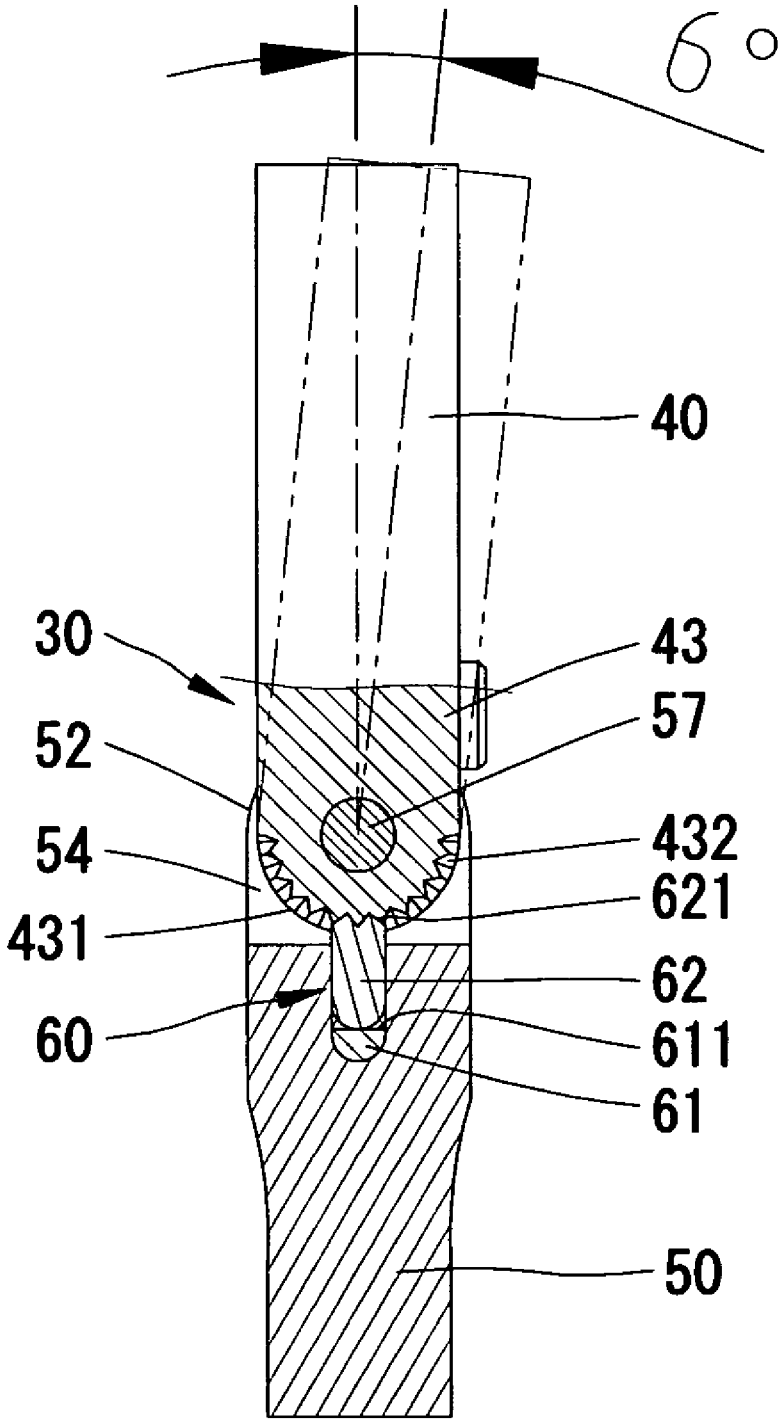
FIG. 11 is a side view, partly sectioned, of the wrench in FIG. 7.
Figure 12:
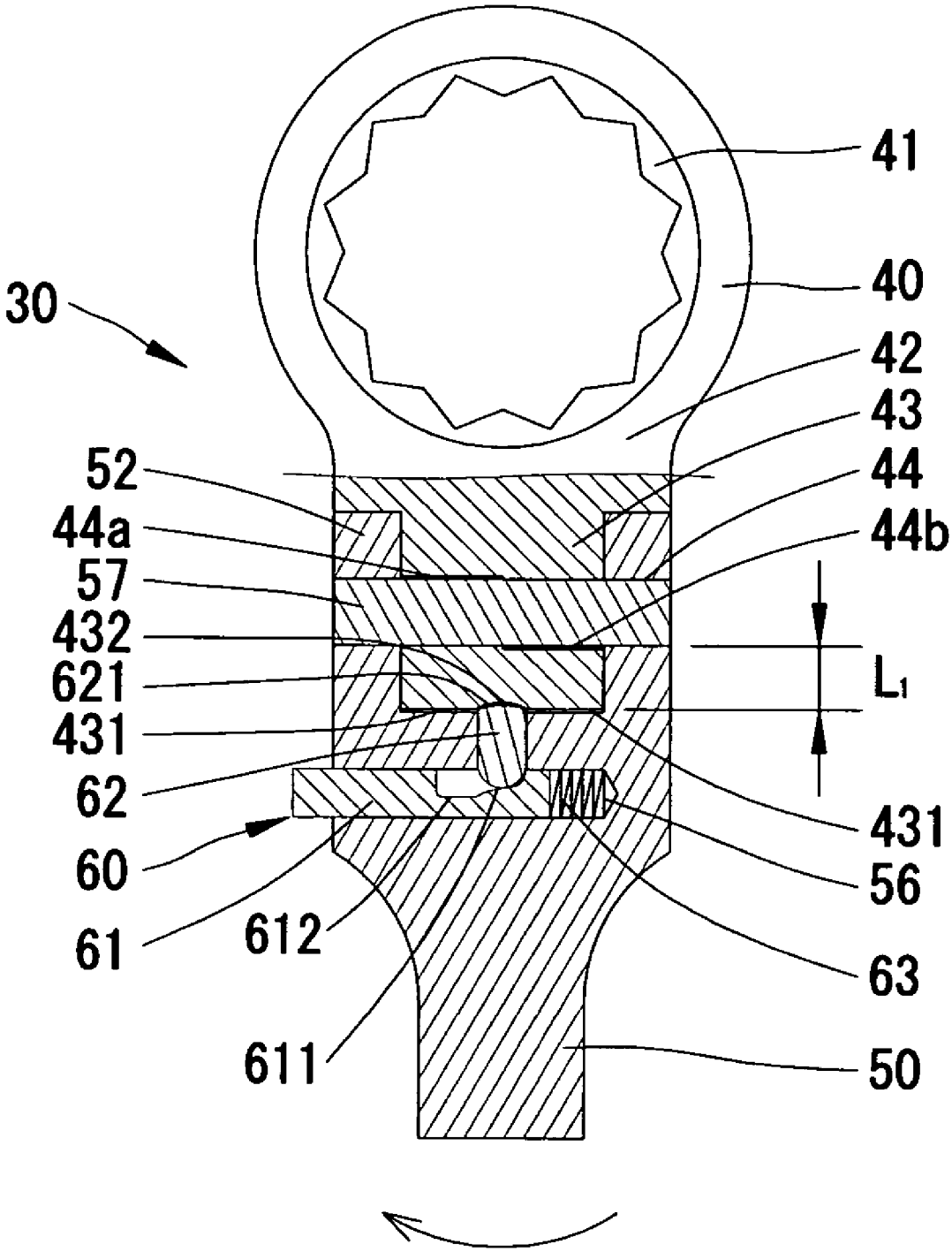
FIG. 12 is a top view, partly sectioned, of the wrench in FIG. 7.

In use, referring to FIGS. 11 and 12, the push member 61 is biased by the elastic element 63 such that the other end of the catch 62 presses against the first face 611 of the push member 61 and that the toothed portion 621 of the catch 62 is engaged with the teeth of the pivotal portion 43 of the head 40. Thus, the head 40 is retained in a desired angular position relative to the handle 50, allowing joint rotation of the head 40 and the handle 50. When the push member 61 is pushed, the elastic element 63 is compressed, and the other end of the catch 62 presses against the second face 612 of the push member 61, and the toothed portion 621 of the catch 62 is allowed to be disengaged from the teeth of the pivotal portion 43. Thus, the head 40 may be pivoted relative to the handle 50 until the head 40 reaches a desired angular position relative to the handle 50. It is noted that the intermediate portion 432 of the pivotal portion 43 may include as many as thirty (30) teeth on the arcuate outer surface section thereof. Thus, the head 40 has thirty angular positions relative to the handle 50, with two adjacent angular positions being spaced apart from each other by only six (6) degrees, best shown in FIG. 11. This allows the wrench 30 to be conveniently operated in a limited space.

Still referring to FIG. 12, when turning the handle 50 clockwise, the head 40 turns together with the handle 50. The pivotal portion 43 is subjected to a torque at sections 44*a* and 44*b* when the wrench 30 is turned clockwise for driving a fastener. Since the thickness of the respective end portion 431 of the pivotal portion 43 is not reduced, it is less likely to crack or damage the torque-bearing section 44*b*. Namely, the torque-bearing capacity of the wrench 30 is not sacrificed even though the head 40 is designed to be pivotably adjusted to a desired angular position relative to the handle 50. The drive member 41 is so configured that a fastener engaged with the drive member is tightened or loosened when the handle 50 is turned in a torque-applying direction and that the fastener is not turned when the handle 50 is turned in a reverse direction. Such a drive member 41 is conventional and therefore not described in detail.

Figure 13:
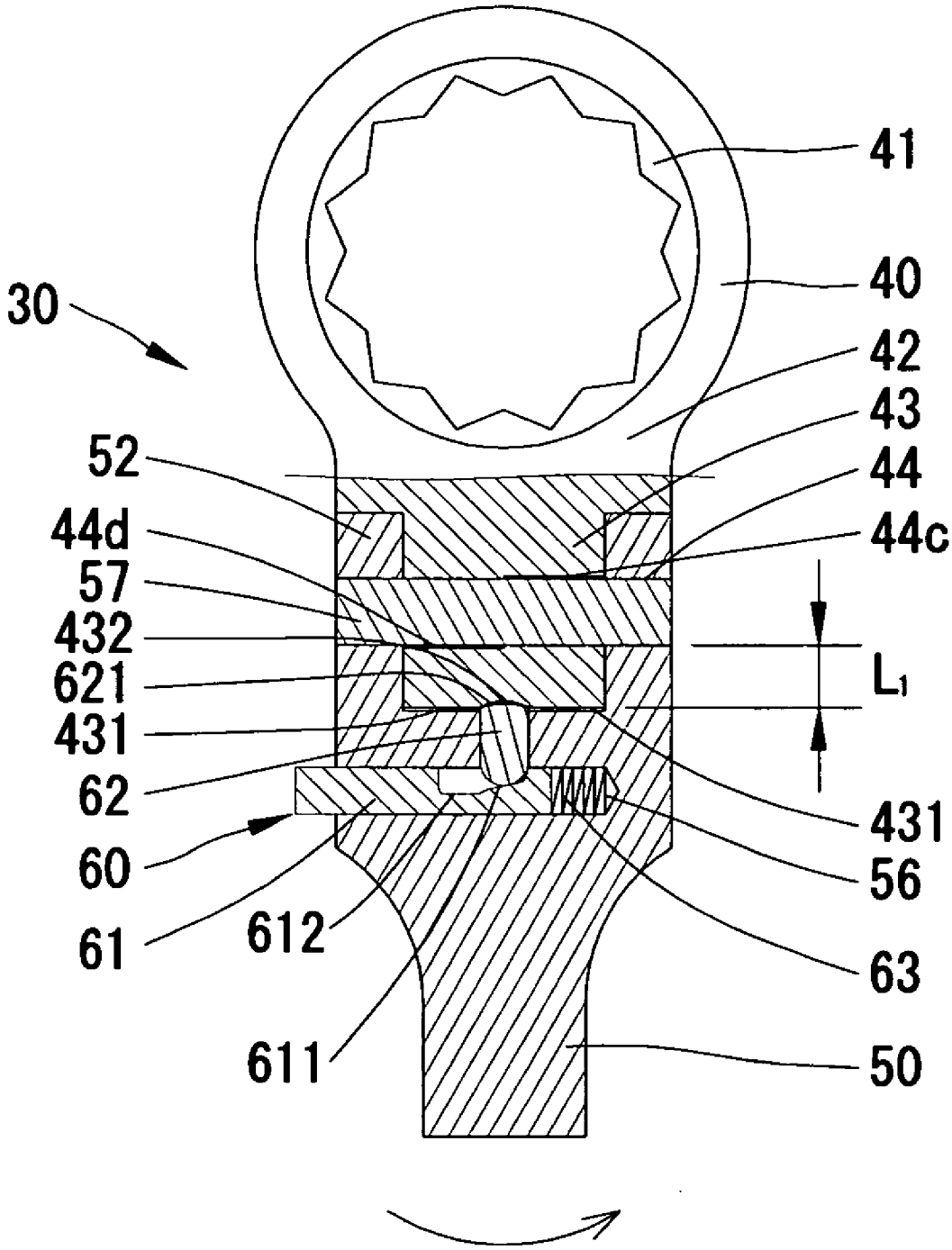
FIG. 13 is a view similar to FIG. 12, illustrating operation of the wrench in a reverse direction.

The switch 45 can be manually operated to change the ratcheting direction so that a fastener engaged with the drive member 41 is tightened or loosened when the handle 50 is turned counterclockwise and that the fastener is not turned when the handle 50 is turned clockwise. Referring to FIG. 13, the pivotal portion 43 is subjected to a torque at sections 44*c* and 44*d* when the wrench 30 is turned counterclockwise for driving a fastener. Since the thickness of the respective end portion 431 of the pivotal portion 43 is not reduced, it is less likely to crack or damage the torque-bearing section 44*d*. Namely, the torque-bearing capacity of the wrench 30 is not sacrificed even though the head 40 is designed to be pivotably adjusted to a desired angular position relative to the handle 50.

Figure 14:
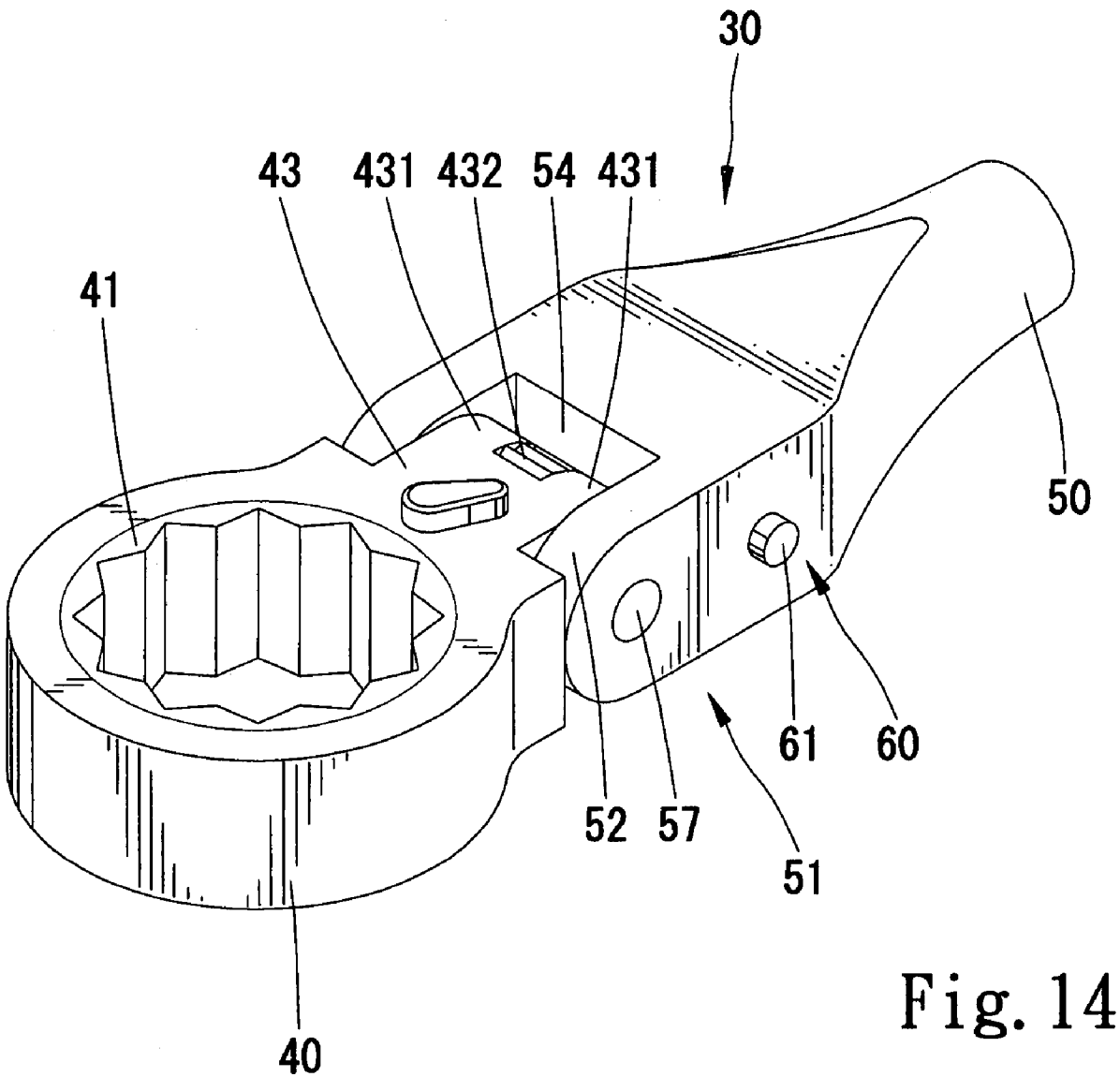
FIG. 14 is a perspective view of a modified embodiment of the wrench in accordance with the present invention.
Figure 15:
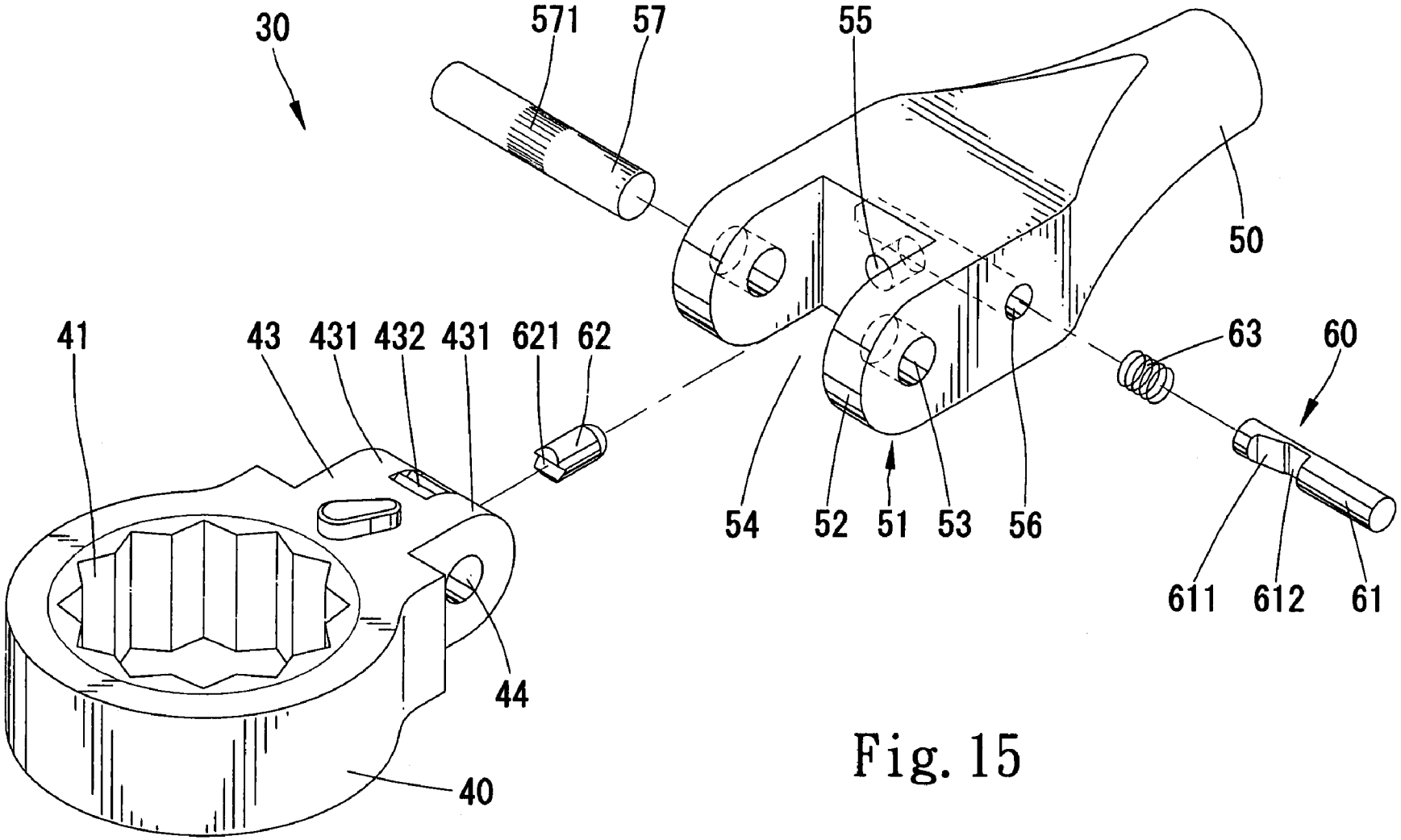
FIG. 15 is an exploded perspective view of the modified embodiment in FIG. 14.

FIGS. 14 and 15 illustrate a modified embodiment of the head 40. In this embodiment, the respective teeth of the pivotal portion 43 are rectilinear.

Figure 16:
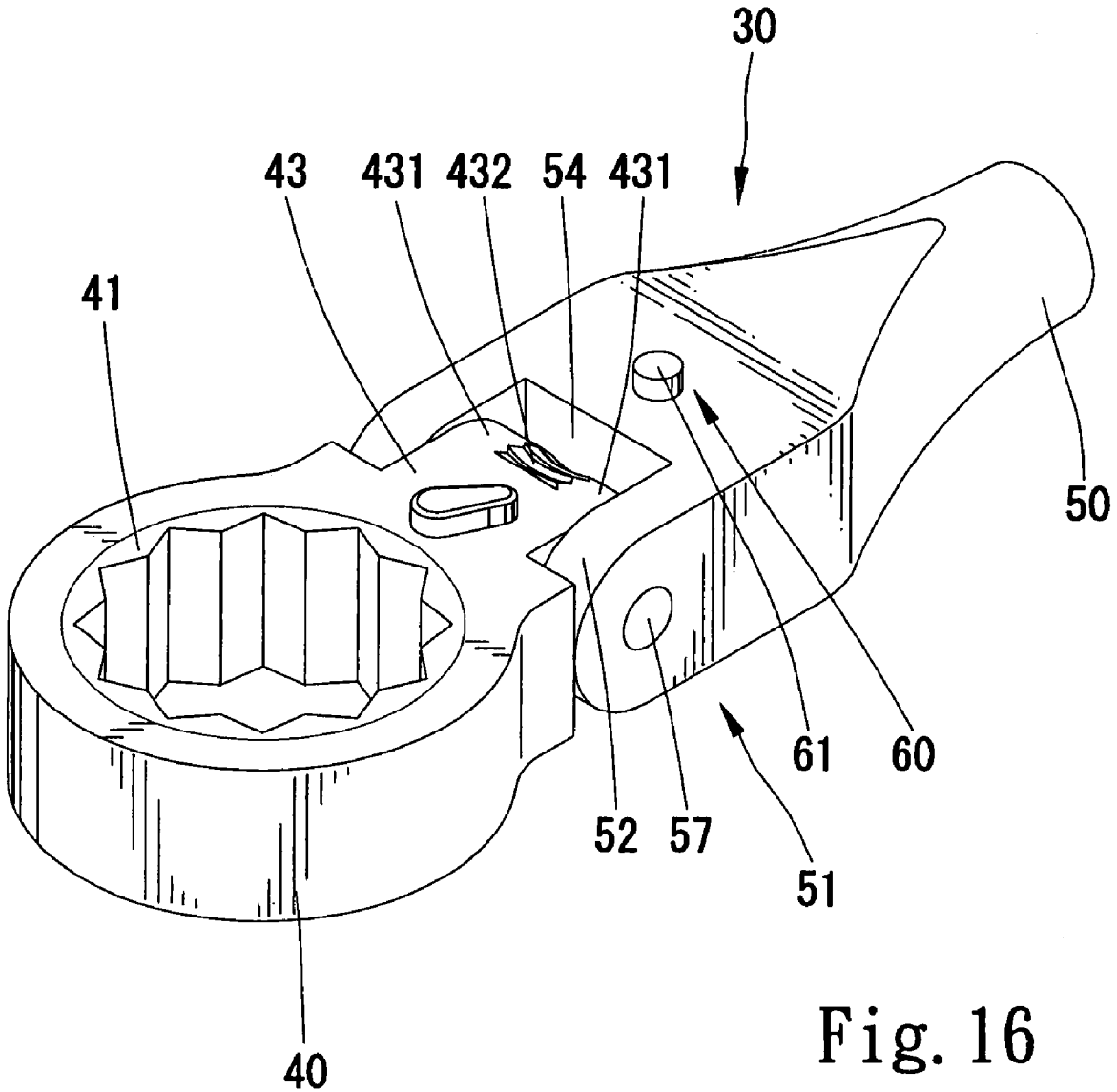
FIG. 16 is a perspective view of another modified embodiment of the wrench in accordance with the present invention.
Figure 17:
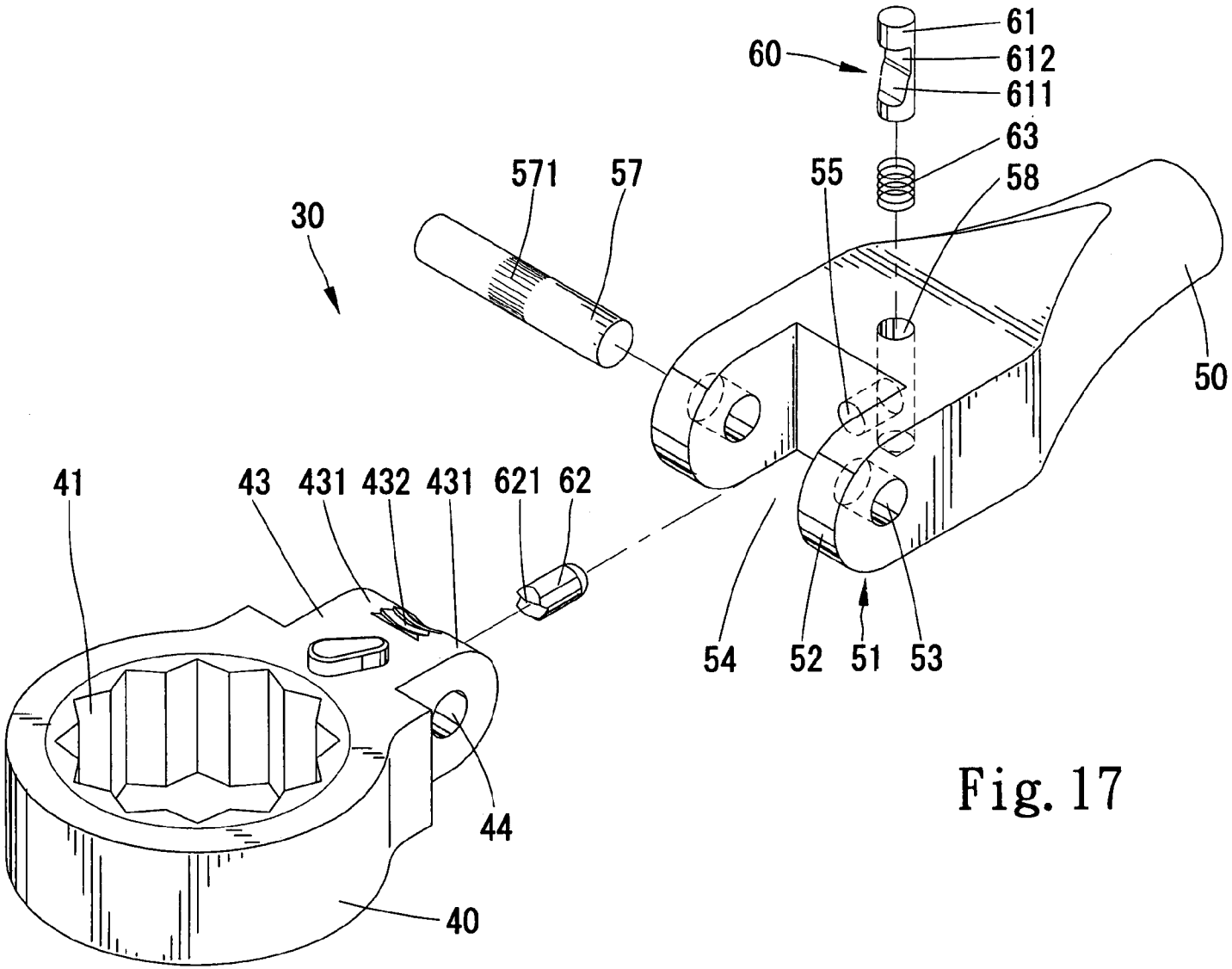
FIG. 17 is an exploded perspective view of the modified embodiment in FIG. 16.

FIGS. 16 and 17 illustrate another modified embodiment of the head 40. In this embodiment, the tip diameter circle of the teeth of the intermediate portion 432 of the pivotal portion 43 is higher than the arcuate outer surface section 433 of the respective end portion 431 of the pivotal portion 43. Namely, a distance from the tip diameter circle of the teeth of the intermediate portion 432 of the pivotal portion 43 to the periphery delimiting the pin hole 44 of the head 40 is greater than that from the arcuate outer surface section 433 of the respective end portion 431 of the pivotal portion 43 to the periphery delimiting the pin hole 44 of the head 40. Further, the root circle of the teeth of the intermediate portion 432 of the pivotal portion 43 is lower than the arcuate outer surface section 433 of the respective end portion 431 of the pivotal portion 43. Namely, a distance from the root circle of the teeth of the intermediate portion 432 of the pivotal portion 43 to the periphery delimiting the pin hole 44 of the head 40 is smaller than that from the arcuate outer surface section 433 of the respective end portion 431 of the pivotal portion 43 to the periphery delimiting the pin hole 44 of the head 40. Further, the receptacle (now designed by 58) is oriented along a vertical direction; namely the receptacle 58 opens in a top of the handle 50.

Figure 18:
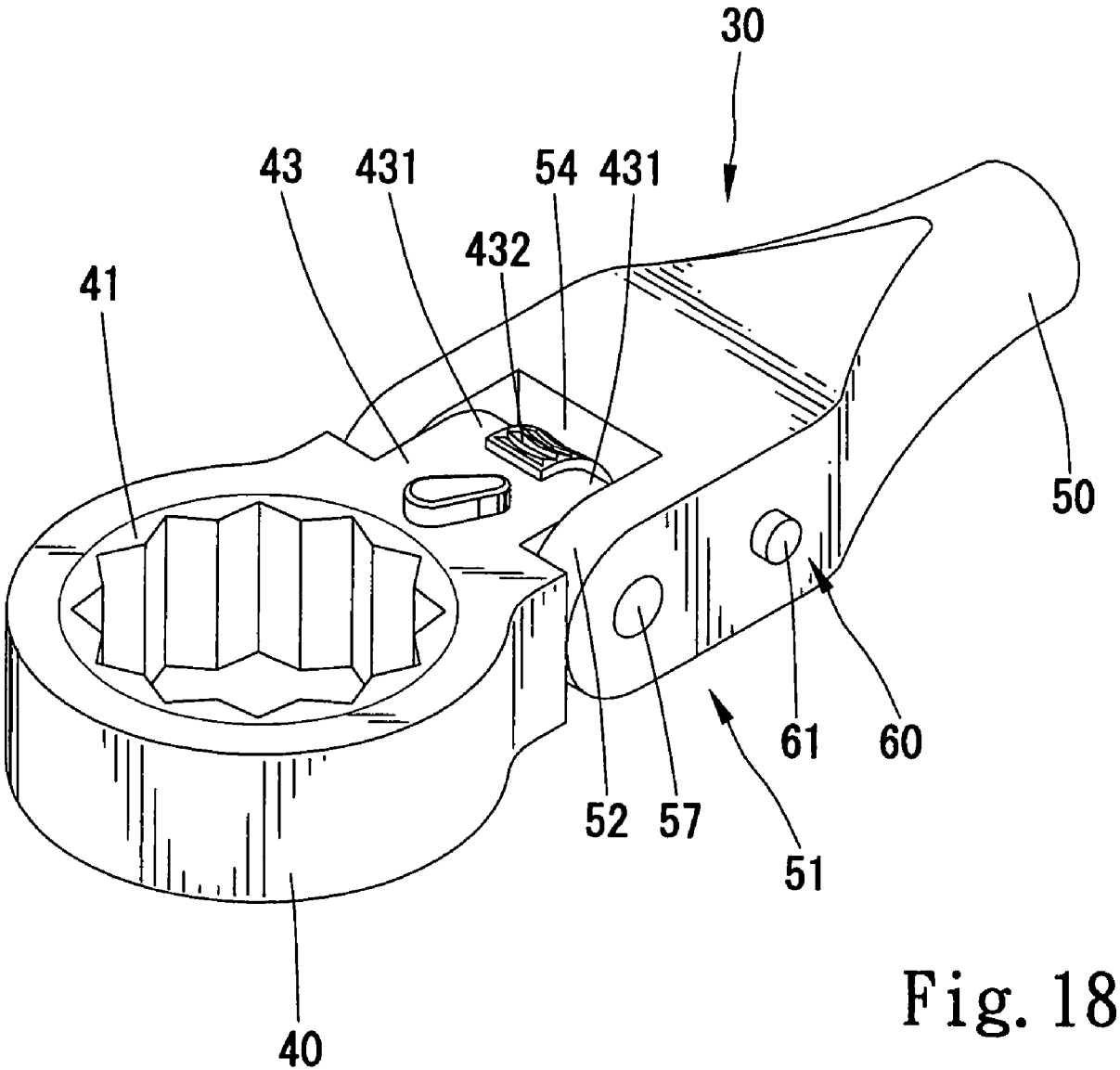
FIG. 18 is a perspective view of a further modified embodiment of the wrench in accordance with the present invention.
Figure 19:
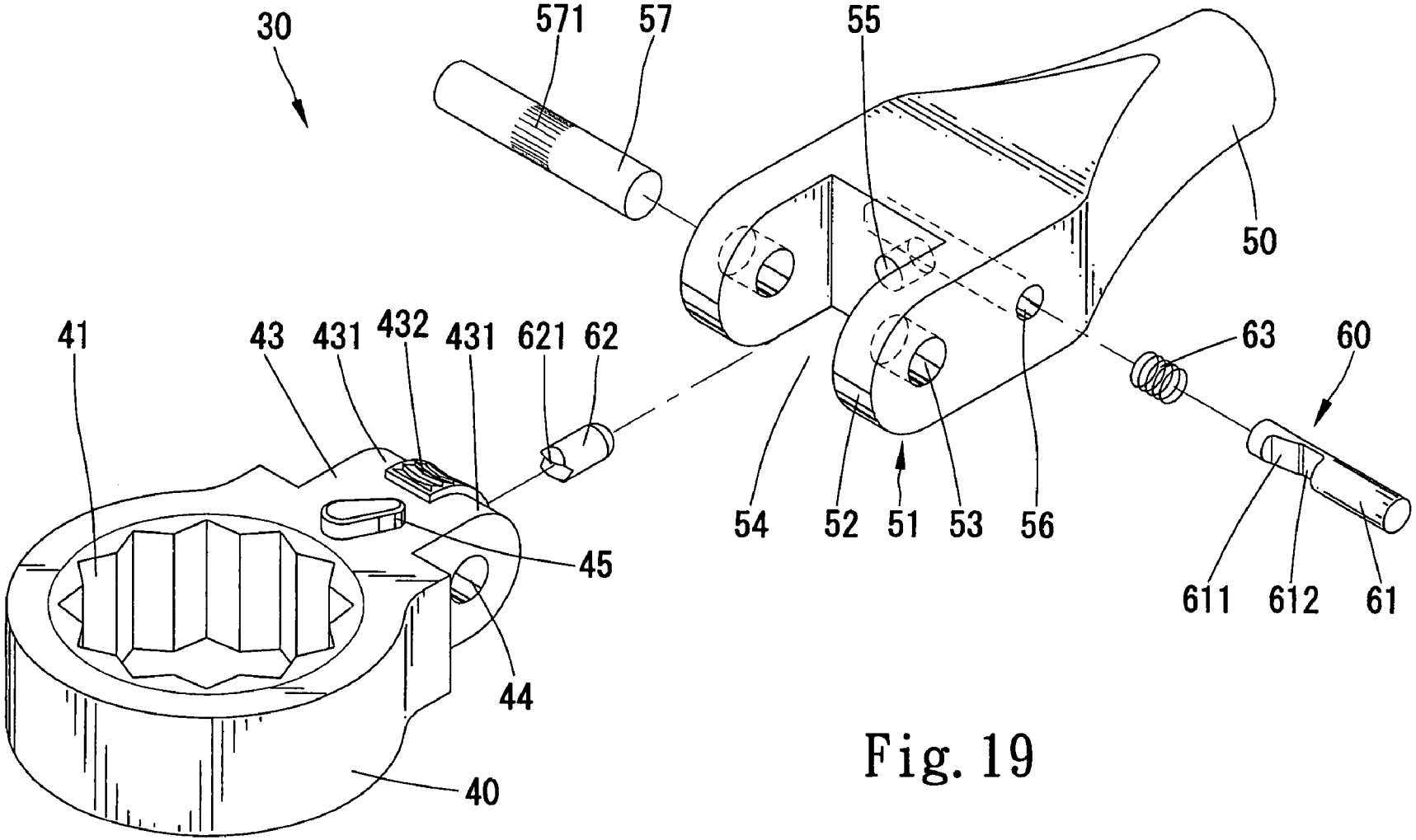
FIG. 19 is an exploded perspective view of the modified embodiment in FIG. 18.

FIG. 18 is a perspective view of a further modified embodiment of the wrench in accordance with the present invention. FIG. 19 is an exploded perspective view of the modified embodiment in FIG. 18. The only difference between the embodiment of FIGS. 18 and 19 and the embodiment of FIGS. 16 and 17 is that the teeth of the intermediate portion 432 of the pivotal portion 43 of the head 40 in FIGS. 18 and 19 are defined in a bulged portion (not labeled) of the intermediate portion 432 of the pivotal portion 43.

Although the invention has been explained in relation to its preferred embodiments, it is to be understood that many other possible modifications and variations can be made without departing from the scope of the invention as hereinafter claimed.

What is claimed is:

1. A wrench comprising:

a handle having an end;

a head including a pivotal portion pivotably connected to the end of the handle, the pivotal portion of the head including first and second sides, first and second end portions and an intermediate portion between the first and second end portions, the intermediate portion including a toothed section having a plurality of teeth, with the first end portion extending from the first side towards but spaced from the second side, with the second end portion extending from the second side towards but spaced from the first side, with the toothed section being spaced from the first and second sides by the first and second end portions, with the first and second end portions each having a smooth arcurate outer surface section free of teeth, with the toothed section of the intermediate portion of the pivotal portion having a root circle located lower than the arcuate outer surface section of the respective end portion, and with the toothed section of the intermediate portion of the pivotal portion having a tip diameter circle located higher than the arcuate outer surface section of the respective end portion; and a retaining mechanism for releasably engaging with the teeth of the intermediate portion of the pivotal portion, allowing the head to be pivotally moved to a desired position relative to the handle and retaining the head in the desired position.

2. The wrench as claimed in claim 1, with the toothed section being spaced at an equal extent from the first and second sides.

3. The wrench as claimed in claim 1, wherein each of the plurality of teeth of the pivotal portion of the head is arcuate between the first and second end portions and of a shape adapted to be formed by milling in a milling cutter.

4. A wrench comprising:

a handle having an end;

a head including a pivotal portion pivotably connected to the end of the handle, the pivotal portion of the head including first and second sides, first and second end portions and an intermediate portion between the first and second end portions, the intermediate portion including a toothed section having a plurality of teeth, with the first end portion extending from the first side towards but spaced from the second side, with the second end portion extending from the second side towards but spaced from the first side, with the toothed section being spaced from the first and second sides by the first and second end portions, wherein each of the plurality of teeth of the pivotal portion of the head has a tip diameter circle which is arcuate between the first and second end portions and of a shape adapted to be formed by milling in a milling cutter, with the first and second end portions each having a smooth arcurate outer surface section free of teeth; and a retaining mechanism for releasably engaging with the teeth of the intermediate portion of the pivotal portion, allowing the head to be pivotally moved to a desired position relative to the handle and retaining the head in the desired position.

5. The wrench as claimed in claim 4, wherein the end of the handle includes a pair of spaced apart lugs, the pivotal portion of the head including a pin hole, with a pin extending through the lugs and the pin hole of the pivotal portion, with the first and second sides abutting the pair of spaced apart lugs.

6. The wrench as claimed in claim 4, wherein the end of the handle includes a receptacle extending in a direction perpendicular to a longitudinal direction of the handle, an axial hole being defined in the end of the handle and communicated with the receptacle, the retaining mechanism including an elastic element and a push member mounted in the receptacle, the retaining mechanism further having a catch slidably mounted in the axial hole, the catch being urged by the push member, under an action of the elastic element, to be engaged with the toothed portion of the pivotal portion of the head.

7. The wrench as claimed in claim 6, wherein the push member includes a recessed portion having a first face and a second face that is located in a level different than that of the first face.

8. The wrench as claimed in claim 6, wherein the receptacle opens in one of two lateral sides of the handle.

9. The wrench as claimed in claim 6, wherein the receptacle opens in a top of the handle.

10. The wrench as claimed in claim 4, wherein the head includes a drive member mounted therein for engaging and driving a fastener, with the wrench further including a switch for changing a ratcheting direction of the drive member.

11. The wrench as claimed in claim 4, with each of the plurality of teeth of the toothed section of the intermediate portion of the pivotal portion having the tip diameter circle located not higher than the arcuate outer surface section of the respective end portion.

12. The wrench as claimed in claim 11, with the toothed section being spaced at an equal extent from the first and second sides.

13. A wrench comprising:

a handle having an end;

a head including a pivotal portion pivotably connected to the end of the handle, the pivotal portion of the head including first and second sides, first and second end portions and an intermediate portion between the first and second end portions, the intermediate portion including a toothed section having a plurality of teeth, with the first end portion extending from the first side towards but spaced from the second side, with the second end portion extending from the second side towards but spaced from the first side, with the toothed section being spaced from the first and second sides by the first and second end portions, wherein each of the plurality of teeth of the pivotal portion of the head is rectilinear and of a constant size between the first and second end portions, with the first and second end portions each having a smooth arcurate outer surface section free of teeth; and a retaining mechanism for releasably engaging with the teeth of the intermediate portion of the pivotal portion, allowing the head to be pivotally moved to a desired position relative to the handle and retaining the head in the desired position.

14. A head for a handle of a wrench, the head including a pivotal portion adapted to be pivotally connected to an end of a handle, the pivotal portion of the head including first and second sides, first and second end portions and an intermediate portion between the first and second end portions, the intermediate portion including a toothed section having a plurality of teeth adapted to be releasably engaged with a retaining mechanism mounted in the handle, allowing the head to be pivotally moved to a desired position relative to the handle and retaining the head in the desired position, with the first end portion extending from the first side towards but spaced from the second side, with the second end portion extending from the second side towards but spaced from the first side, with the toothed section being spaced from the first and second sides by the first and second end portions, with the first and second end portions each having a smooth arcurate outer surface section free of teeth, with the toothed section of the intermediate portion of the pivotal portion having a root circle located lower than the arcuate outer surface section of the respective end portion, and with the toothed section of the intermediate portion of the pivotal portion having a tip diameter circle located higher than the arcuate outer surface section of the respective end portion.

15. The head as claimed in claim 14, with the toothed section being spaced at an equal extent from the first and second sides.

16. The head as claimed in claim 14, wherein each of the plurality of teeth of the pivotal portion of the head is arcuate between the first and second end portions and of a shape adapted to be formed by milling in a milling cutter.

17. A head for a handle of a wrench, the head including a pivotal portion adapted to be pivotally connected to an end of a handle, the pivotal portion of the head including first and second sides, first and second end portions and an intermediate portion between the first and second end portions, the intermediate portion including a toothed section having a plurality of teeth adapted to be releasably engaged with a retaining mechanism mounted in the handle, allowing the head to be pivotally moved to a desired position relative to the handle and retaining the head in the desired position, with the first end portion extending from the first side towards but spaced from the second side, with the second end portion extending from the second side towards but spaced from the first side, with the toothed section being spaced from the first and second sides by the first and second end portions, wherein each of the plurality of teeth of the pivotal portion of the head has a tip diameter circle which is arcuate between the first and second end portions and of a shape adapted to be formed by milling in a milling cutter, with the first and second end portions each having a smooth arcurate outer surface section free of teeth.

18. The head as claimed in claim 17, with each of the plurality of teeth of the toothed section of the intermediate portion of the pivotal portion having the tip diameter circle located not higher than the arcuate outer surface section of the respective end portion.

19. The wrench as claimed in claim 17, with the toothed section being spaced at an equal extent from the first and second sides.

20. A head for a handle of a wrench, the head including a pivotal portion adapted to be pivotally connected to an end of a handle, the pivotal portion of the head including first and second sides, first and second end portions and an intermediate portion between the first and second end portions, the intermediate portion including a toothed section having a plurality of teeth adapted to be releasably engaged with a retaining mechanism mounted in the handle, allowing the head to be pivotally moved to a desired position relative to the handle and retaining the head in the desired position, with the first end portion extending from the first side towards but spaced from the second side, with the second end portion extending from the second side towards but spaced from the first side, with the toothed section being spaced from the first and second sides by the first and second end portions, wherein each of the plurality of teeth of the pivotal portion of the head is rectilinear and of a constant size between the first and second end portions, with the first and second end portions each having a smooth arcurate outer surface section free of teeth.

* * * * *